US010519683B2

(12) United States Patent
Bartminn

(10) Patent No.: US 10,519,683 B2
(45) Date of Patent: Dec. 31, 2019

(54) LATTICE MAST STRUCTURE AND METHOD FOR INCREASING THE STABILITY OF A LATTICE MAST STRUCTURE

(71) Applicant: innogy SE, Essen (DE)

(72) Inventor: Daniel Bartminn, Elmshorn (DE)

(73) Assignee: INNOGY SE, Essen (DE)

( * ) Notice: Subject to any disclaimer, the term of this patent is extended or adjusted under 35 U.S.C. 154(b) by 0 days.

(21) Appl. No.: 15/580,878

(22) PCT Filed: May 30, 2016

(86) PCT No.: PCT/EP2016/062115
§ 371 (c)(1),
(2) Date: Feb. 15, 2018

(87) PCT Pub. No.: WO2016/198270
PCT Pub. Date: Dec. 15, 2016

(65) Prior Publication Data

US 2018/0355631 A1 Dec. 13, 2018

(30) Foreign Application Priority Data

Jun. 9, 2015 (DE) ..... 10 2015 210 474

(51) Int. Cl.
*E04H 12/10* (2006.01)
*E04H 12/16* (2006.01)
*E04C 5/07* (2006.01)

(52) U.S. Cl.
CPC ..... *E04H 12/10* (2013.01); *E04C 5/07* (2013.01); *E04H 12/16* (2013.01)

(58) Field of Classification Search
CPC ..... E04H 12/10; E04H 12/16; E04C 5/07
See application file for complete search history.

(56) References Cited

U.S. PATENT DOCUMENTS 2,988,182 A * 6/1961 Campbell ..... E04C 3/32 248/354.1
9,038,348 B1 * 5/2015 Fang ..... E04B 1/19 52/651.01

(Continued)

FOREIGN PATENT DOCUMENTS

DE 818108 10/1951
DE 19939799 2/2001

(Continued)

OTHER PUBLICATIONS

Search Report and Written Opinion for corresponding German Patent Application No. 10 2015 210 474.5 (7 pages). (Year: 2016).*

(Continued)

*Primary Examiner* — Rodney Mintz
(74) *Attorney, Agent, or Firm* — Grossman, Tucker, Perreault & Pfleger, PLLC

(57) ABSTRACT

The invention relates to a lattice mast structure which comprises a plurality of supports which are designed as steel profiles and between which transverse and/or diagonal struts extend, wherein the lattice mast structure comprises at least one reinforcing bar, wherein the reinforcing bar extends in the longitudinal direction of a support, the reinforcing bar follows the course of the support, the reinforcing bar is connected to the support at at least two points which are remote from one another, with the result that the reinforcing bar forms a structural unit with said support with respect to the force flow and the reinforcing bar is designed as an at least two-part composite component which is formed as a structural unit consisting of an element which predominantly transfers tensile forces and an element which predominantly transfers compressive forces.

17 Claims, 2 Drawing Sheets

(56) References Cited

U.S. PATENT DOCUMENTS

| | | | | |
|---|---|---|---|---|
| 9,698,585 | B2 * | 7/2017 | Ma | E04H 12/02 |
| 9,719,242 | B2 * | 8/2017 | Bell | E04B 1/1903 |
| 10,184,260 | B2 * | 1/2019 | Bartminn | E04H 12/10 |
| 2005/0166521 | A1 * | 8/2005 | Silber | E04H 12/10 52/633 |
| 2006/0042181 | A1 * | 3/2006 | Foo | B63B 35/4413 52/633 |
| 2008/0092478 | A1 * | 4/2008 | Min | E04H 12/10 52/651.01 |
| 2009/0300996 | A1 | 12/2009 | Jones | |
| 2010/0218708 | A1 | 9/2010 | Carr et al. | |
| 2010/0326007 | A1 * | 12/2010 | Silber | E04G 21/12 52/741.4 |
| 2011/0265419 | A1 * | 11/2011 | De Abreu | E04H 12/10 52/651.01 |
| 2013/0014467 | A1 | 1/2013 | Ehsani | |
| 2013/0047544 | A1 * | 2/2013 | Dayton | E04H 12/10 52/634 |
| 2013/0058708 | A1 * | 3/2013 | Stiesdal | E02D 27/42 403/230 |
| 2015/0107181 | A1 * | 4/2015 | Larsen | E04B 1/1903 52/655.1 |
| 2015/0152664 | A1 * | 6/2015 | Larsen | B21C 37/296 52/651.07 |
| 2015/0167644 | A1 * | 6/2015 | Fang | E04B 1/19 52/651.01 |
| 2015/0295392 | A1 * | 10/2015 | Ma | E04H 12/02 174/45 R |
| 2016/0060886 | A1 * | 3/2016 | Cook | E04G 23/0225 52/514 |
| 2017/0016241 | A1 * | 1/2017 | Bartminn | E04H 12/10 |
| 2017/0081837 | A1 * | 3/2017 | Bell | E04B 1/1903 |
| 2017/0241140 | A1 * | 8/2017 | Teng | E04C 3/34 |
| 2017/0298647 | A1 * | 10/2017 | Bartminn | E04H 12/10 |
| 2017/0335568 | A1 * | 11/2017 | Schmidt | E04C 5/07 |

FOREIGN PATENT DOCUMENTS

| | | |
|---|---|---|
| EP | 2381052 | 10/2011 |
| GB | 518718 | 1/1943 |
| GB | 678859 | 7/1952 |
| JP | 09-217419 | 8/1997 |
| JP | 2001-003600 | 1/2001 |
| JP | 2005-248487 | 9/2005 |
| JP | 2006-028902 | 2/2006 |
| WO | 2005/026450 | 3/2005 |
| WO | 2009/098528 | 8/2009 |

OTHER PUBLICATIONS

English translation of International Search Report from corresponding PCT Appln. No. PCT/EP2016/062115, dated Aug. 18, 2016.

English translation of International Preliminary Report on Patentability from corresponding PCT Appln. No. PCT/EP2016/062115, dated Oct. 25, 2017.

* cited by examiner

LATTICE MAST STRUCTURE AND METHOD FOR INCREASING THE STABILITY OF A LATTICE MAST STRUCTURE

FIELD

The invention relates to a lattice mast structure comprising supports, which are designed as steel profiles, and diagonal struts or cross-struts extending between the supports or diagonal struts and cross-struts extending between the supports.

The invention further relates to a method for increasing the stability of such a lattice mast structure as a subsequent upgrading measure.

BACKGROUND

Lattice mast structures of the above-designated type are open steel framework constructions with angle profiles or round profiles on bridges, in the form of pylons or power line masts. Such lattice mast structures have the advantage that they are particularly lightweight and can be built up easily. Particularly if the lattice mast structure consists of angle profiles, the individual profile struts can be connected to one another relatively easily, for example by riveting, welding or bolting.

Lattice mast structures are predominantly used as lattice masts for receiving overhead electricity transmission lines. Lattice masts are usually built up from a series of structural elements arranged above one another, with each stage forming a framework structure which has three or more trapezoidal framework panels which each consist of supports which are braced to one another. The supports are designed as angle profiles, and the struts connecting them in the form of cross-struts or diagonal struts can also be formed in part as angle profiles, and in part also as plate profiles.

The design of such framework structures is generally subordinated to the requirements for the bearing load and for the wind load acting on the construction. Furthermore, the forces from intrinsic weight, tensioning, ice and temperature have to be taken into account in the design.

The dimensioning of the structural elements forming the framework structure is dependent, on the one hand, on the free buckling length of the individual elements and on the tensile or compressive stress prevailing in the latter and, on the other hand, on the interaction of longitudinal forces and lateral forces which are introduced into the construction, for example, by wind loads.

In order to stabilize lattice constructions or framework structures of the above-described type, numerous bracing systems are known which are optimized with respect to the arrangement of the framework struts and with regard to the total weight of the lattice structure. Such a system is described, for example, in GB 675,859 A.

The optimal design of the structure for the expected wind load and bearing load relative to the optimal weight generally presents relatively few problems in the erection of new lattice masts or lattice mast structures.

In the case of existing lattice masts for overhead electricity transmission lines, for example, it may be necessary from time to time to repair and/or replace parts of the structure. In some circumstances, this requires new stability checks. Existing installations do not meet increased stability requirements in some circumstances, in particular also owing to increased load requirements or owing to a structural weakness which is to be expected after standing for a relatively long period of time.

It is sometimes necessary for lattice masts to receive additional lines on their mast cross-arms because, for example, a greater electrical power has to be provided in an electrical power network.

In such cases, an upgrading of the existing lattice masts is required, in particular if the free buckling length of the steel profiles is not designed for an increased bearing load or the cross section as such does not have sufficient bearing capacity.

SUMMARY

The object on which the invention is based is therefore to provide an upgraded lattice mast structure and a method for upgrading conventional lattice mast structures.

A lattice mast structure within the sense of the present invention is to be understood as meaning an open framework structure whose struts are not provided with infilling.

Examples of lattice mast structure which come into consideration are lattice masts for receiving overhead electricity transmission lines, pylons, bridge piers or the like which are to be upgraded in the direction of extent of steel profiles designed as supports, with regard to the desired buckling stability.

According to one aspect of the invention, a lattice mast structure is provided comprising supports, which are designed as steel profiles, and diagonal struts or cross-struts extending between the supports or diagonal struts and cross-struts extending between the supports, wherein the lattice mast structure comprises at least one reinforcing bar, wherein the reinforcing bar extends in the longitudinal direction in a support or a cross-strut or a diagonal strut, the reinforcing bar follows in the course of the support or the cross-strut (6) or the diagonal strut, the reinforcing bar is connected to the support or the cross-strut (6) or the diagonal strut at at least two points which are remote from one another, with the result that the reinforcing bar forms a structural unit with the support or the cross-strut or the diagonal strut with respect to the force flow through said support or said cross-strut or said diagonal strut and the reinforcing bar is designed as an at least two-part component which is formed as a preferably two-part structural unit consisting of an element which predominantly transfers tensile forces and an element which predominantly transfers compressive forces.

A steel profile within the sense of the present invention can be understood as meaning a round profile or else an angle profile.

An angle profile within the sense of the present invention is to be understood for example as meaning a T-profile, L-profile, I-profile, Z-profile, U-profile, C-profile or the like.

The lattice mast structure within the sense of the present invention can be designed, for example, as a steel framework structure with three or four supports, in particular supports which can converge in the direction of a mast tip. Here, in each case two supports together with cross-struts can form trapezoidal panels of a mast stage. A plurality of mast stages can extend vertically from a base of the lattice mast to its mast tip. The lattice mast can have, for example, mast cross-arms which are arranged symmetrically to the supports and which in turn have a corresponding framework structure and taper from a base to their remote end.

An element which predominantly transfers tensile forces within the sense of the present invention is to be understood as meaning an element which can transfer larger tensile forces than compressive forces. What is preferably to be understood by this is an element which can transfer tensile forces which are more than twice as high as compressive forces.

An element which transfers compressive forces within the sense of the present invention is to be understood as meaning an element which can transfer more compressive forces than tensile forces, preferably compressive forces which are more than twice as high as tensile forces.

The element transferring tensile forces is preferably chosen from a group comprising cables, fibers, non-crimp fabrics, woven fabrics or meshes consisting of steel, glass fibers or carbon fibers. The element transferring compressive forces is preferably chosen from a group comprising concrete, polymer concrete, mineral casting compounds and thermoplastic, nonfoamed and thermoplastic and foamed casting compounds.

The element transferring tensile forces can be designed, for example, in the form of one or more cables or in the form of a hose.

The basic idea of the invention can be seen in the fact that the free buckling length of the relevant support and thus also its bearing load in the longitudinal direction is increased by means of one or more reinforcing bars on at least one, preferably on a plurality of, supports by a structural unit being formed between the reinforcing bar and the support.

For each support there can be provided, for example, a reinforcing bar which extends in each case over the whole length of the support and which is fixedly connected to the support at a plurality of points at a distance from one another. Alternatively, a plurality of reinforcing bars can be fastened to a support in certain portions over the length thereof.

The design of the reinforcing bar as an at least two-part composite component has the advantage that mounting is greatly simplified as a result. The element transferring tensile forces can be designed as a bendable element which can be laid in a simple manner. The element transferring compressive forces can consist, for example, of a cured casting compound, whereby likewise the handling of the reinforcing bar for mounting purposes is greatly simplified. In a preferred embodiment of the above-described lattice mast structure, there is provision that the reinforcing bar comprises a tensile element consisting of steel and a steel body consisting of a cured casting compound.

For example, the reinforcing bar can comprise one or more steel cables which are embedded in a jacket consisting of a cured casting compound. Alternatively, a parallel arrangement of one or more steel cables and of a body consisting of a cured casting compound is also possible. These can be connected to one another in certain portions. In this case, the curable casting compound can be enclosed, for example, in a flexible textile hose as a laying aid and permanent shuttering for the casting compound.

In an alternative variant of the lattice mast structure, there can be provision that the reinforcing bar has a jacket consisting of a tension-resistant woven steel fabric or a steel-reinforced textile fabric or a steel mesh and a core consisting of a cured casting compound.

The reinforcing bar is preferably in each case connected to the corner support in the region of node points of the lattice mast structure.

In a particularly advantageous variant of the lattice mast structure according to the invention, there can be provision that the element transferring tensile forces is pretensioned. Said element can, for example, be laid from a mast tip of the lattice mast structure to a mast foot or to a mast foundation or a mast base and be pretensioned between the fastening points. Subsequently casting or injecting the curable casting compound into the element which transfers tensile forces means that the tension has been able to be locked in.

For example, there can be provision that the reinforcing bar is connected to a foundation of the lattice mast.

A further aspect of the invention relates to a method for increasing the stability of lattice mast structures as a subsequent upgrading of such lattice mast structures, wherein the lattice mast structure has supports and cross-struts extending between the supports or diagonal struts extending between the supports or diagonal struts and cross-struts extending between the supports, wherein the method comprises the following method steps:

laying at least one hose along at least one support or cross-strut or diagonal strut over at least part of the length of the support or the cross-strut or the diagonal strut, wherein the hose consists of a tension-resistant material or has a tension-resistant reinforcement or encloses a tension-resistant element or is connected to a tension-resistant element, fastening the hose and/or the tension-resistant element at a plurality of fastening points, arranged at a distance from one another, of the support or the cross-strut or the diagonal strut and injecting a curable casting compound into the hose.

The tension-resistant element provided is an element which transfers predominantly tensile forces in the above-described manner.

The hose used can be, for example, a woven steel fabric or steel mesh hose whose lateral surface does not have to be completely closed, with the result that partial penetration of the casting compound through the lateral surface of the hose is possible.

In a variant of the method according to the invention, there is provision that the hose used is a textile hose with a steel reinforcement, wherein the steel reinforcement of the textile hose forms the element transferring the tensile forces or the tension-resistant element. The reinforcement can optionally also be formed from carbon fibers, textile fibers, glass fibers or similar materials.

Alternatively, there can be provision that the hose encloses at least one steel cable, wherein the steel cable is fastened, at least at its two ends, to the support or the cross-strut or the diagonal strut.

In a further alternative embodiment of the method, there can be provision to lay the steel cable and the hose next to one another and to fasten them to one another.

In an expedient variant of the method, there is provision that the hose and/or the tension-resistant element are/is in each case connected to the supports in the region of node points of the lattice structure.

BRIEF DESCRIPTION OF THE DRAWINGS

The invention will be explained below with reference to an exemplary embodiment illustrated in the drawings, in which.

DETAILED DESCRIPTION

Figure 1:
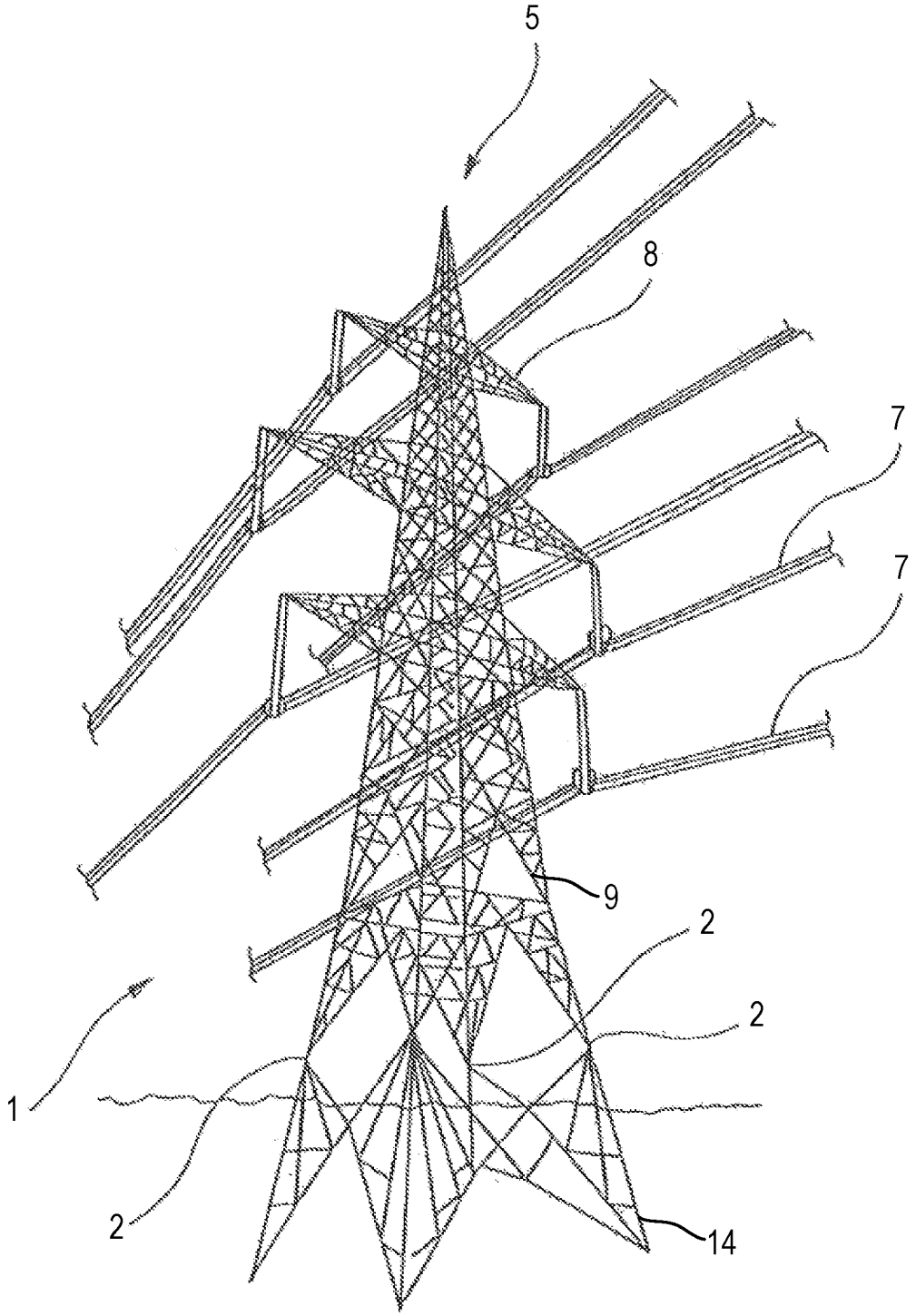
FIG. 1 shows a schematic illustration of a lattice mast as an overhead transmission line mast for receiving overhead electricity transmission lines.

The lattice mast 1 as a lattice mast structure within the sense of the present invention is designed in FIG. 1 as a conventional, open steel framework structure with four supports 2 which in the present case are designed as open angle profiles 3 with two legs 4 of equal length and a vertex 10.

The lattice mast 1 is described here for example as a framework structure with angle profiles, in particular as an open steel framework construction.

As has already been mentioned at the outset, the invention is to be understood in such a way that lattice mast structures and also bridge structures, pylons or similar constructions can be provided as the framework structure.

As can be seen in FIG. 1, in the region where it is erected, the lattice mast occupies a relatively large footprint, and the four supports 2 of the lattice mast 1 converge in the direction of a mast tip 5. In each case two supports 2 form, together with cross-struts 6, trapezoidal panels of a mast stage. Each mast stage is described overall by four trapezoidal panels, and a plurality of mast stages extend vertically from the base of the lattice mast 1 to its mast tip 5. The individual panels of the stages of the lattice mast are designed as framework structures with diagonal struts 9 which act as compression bars or tension bars depending on the magnitude of the transverse loading of the lattice mast.

The lattice mast 1 owes its shape, which tapers in the direction of the mast tip 5, to the expected bending stress on the lattice mast 1 due to wind load and due to lines 7. The lines 7 are suspended from mast cross-arms 8 in a known manner. The geometry of the mast cross-arms is adapted to the expected bending moment distribution resulting from the weight of the lines 7.

Figure 2:
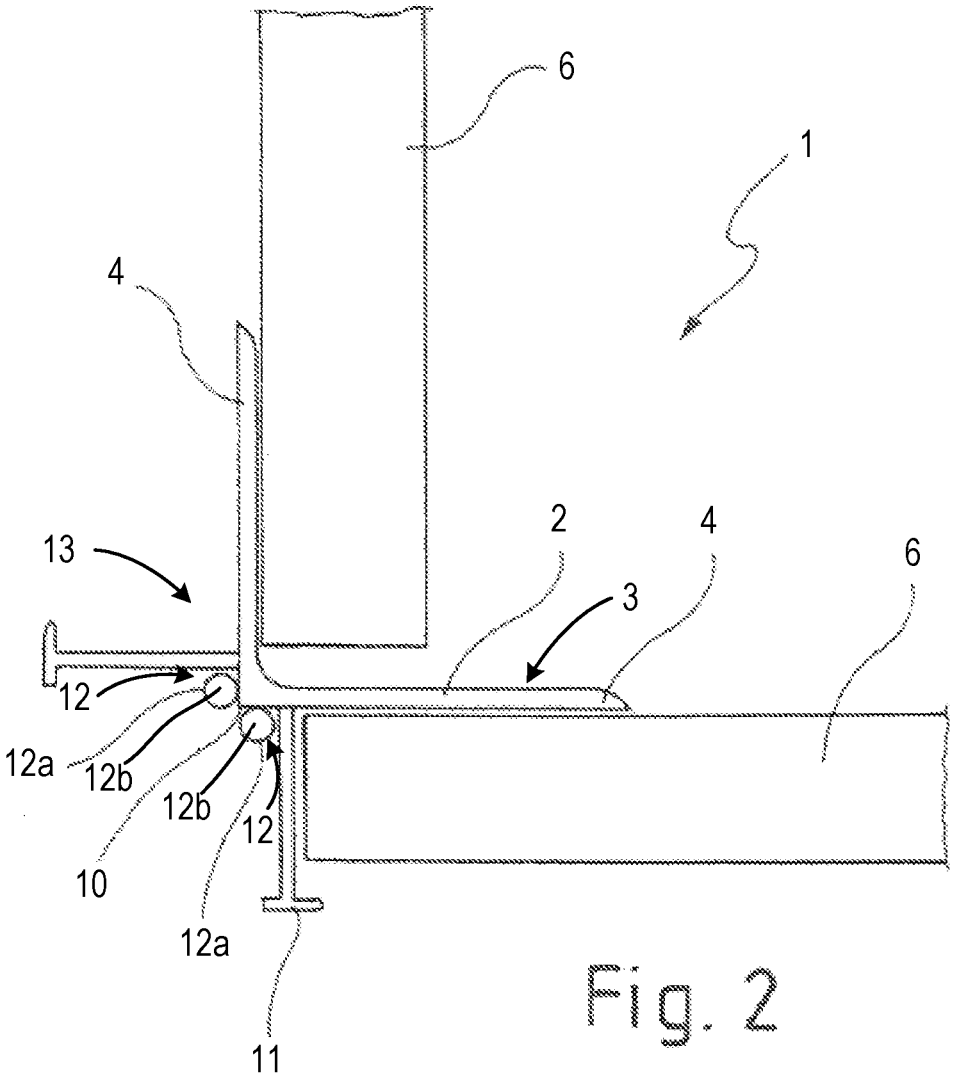
FIG. 2 shows a cross section through a support of the lattice mast illustrated in FIG. 1 having a reinforcing bar according to the invention.

Reference is now made to FIG. 2, which shows a sectional view of a support 2 of the lattice mast 1 as an angle profile 3 within the sense of the present application. The section is illustrated as a cross section at the level of a node point 13 of the framework structure of the lattice mast 1. In the region of the node point 13, two cross-struts 6 leading to adjacent supports 2 are fastened to the legs 4 of the angle profile 3. The vertex 10 of the angle profile 3 of the support 2 points outward of the mast cross section enclosed by the supports 2. Climbing irons on the supports 2 are designated by 11.

As can be seen from the sectional view, two reinforcing bars 12, which are designed according to the invention as a two-part composite component, are fastened to the legs 4 of the angle profile 3 so as to outwardly adjoin the vertex 10. The reinforcing bars 12 comprise a steel mesh jacket 12*a* which is laid as a continuous hose on the relevant support 2 from the foundation 14 (not designated in more detail) of the lattice mast 1 to the mast tip 5, and which is in each case connected to the support 2 in the region of the node points 13 of the framework structure, that is to say in the region of the cross-struts 6 connected to the support 2. The connection can be provided, for example, by means of clamps (not shown) which are welded to the supports 2 or to the angle profiles 3 of the supports 2.

The reinforcing bars 12 further comprise a core 12*b* consisting of a cured casting compound which, starting from below, has been injected into the woven steel fabric hose. The completed and cured reinforcing bars 12 form a structural stiffening of the angle profiles 3 and thus an increase in their bearing load and their free buckling length.

LIST OF REFERENCE SIGNS

1 Lattice mast
2 Supports
3 Angle profiles
4 Legs
5 Mast tip
6 Cross-struts
7 Lines
8 Mast cross-arms
9 Diagonal struts
10 Vertex
11 Climbing irons
12 Reinforcing bars
12*a* Jacket
12*b* Core
13 Node point
14 Foundation

What is claimed is:

1. A lattice mast structure comprising:

supports, which are configured as steel profiles, at least one strut extending between the supports, and at least one reinforcing bar, wherein the reinforcing bar extends parallel in a longitudinal direction of a first support of the supports, the reinforcing bar is connected to at least one of the first support or the at least one strut at at least two points which are remote from one another, such that the reinforcing bar forms a structural unit with at least one of the first support or the at least one strut with respect to a transmission of forces through at least one of the first support or the at least one strut, wherein the reinforcing bar is configured as an at least two-part composite component which is formed as a structural unit comprising an element which transfers tensile forces and an element which transfers compressive forces, wherein the reinforcing bar has a jacket comprising at least one of a steel mesh or a woven steel fabric or a woven textile fabric which is reinforced with at least one of steel, carbon fiber or glass fiber, and wherein the reinforcing bar has a core comprising a cured casting compound.

2. The lattice mast structure as claimed in claim 1, wherein the reinforcing bar comprises a tension element comprising at least one of the steel or the carbon fiber or the glass fiber, and a body comprising the cured casting compound.

3. The lattice mast structure as claimed in claim 1, wherein the core of the reinforcing bar further comprises steel and the jacket further comprises the cured casting compound.

4. The lattice mast structure as claimed in claim 1, wherein the reinforcing bar is connected to the first support in a region of node points of the lattice structure.

5. The lattice mast structure as claimed in claim 1, wherein the element transferring tensile forces is pretensioned.

6. The lattice mast structure as claimed in claim 1, wherein the reinforcing bar is connected to a foundation of the lattice mast.

7. The lattice mast structure as claimed in claim 1, wherein the strut is a diagonal strut.

8. The lattice mast structure as claimed in claim 1, wherein the strut is a cross-strut.

9. The lattice mast structure as claimed in claim 1, wherein the first support is a corner support.

10. The lattice mast structure as claimed in claim 1, wherein the first support comprises an angle profile.

11. The lattice mast structure as claimed in claim 1, wherein the angle profile comprises a first leg and a second leg which form an L-profile.

12. The lattice mast structure as claimed in claim 1, wherein the angle profile comprises a vertex, and the reinforcing bar adjoins the vertex.

13. The lattice mast structure as claimed in claim 1, wherein the lattice mast structure carries electricity transmission lines.

14. A method of providing a lattice mast structure, wherein the method comprises:

forming the lattice mast structure, wherein the lattice mast structure comprises supports, which are configured as steel profiles, at least one strut extending between the supports, and at least one reinforcing bar, wherein the reinforcing bar extends parallel in a longitudinal direction of a first support of the supports, the reinforcing bar is connected to at least one of the first support or the at least one strut at at least two points which are remote from one another, such that the reinforcing bar forms a structural unit with at least one of the first support or the at least one strut with respect to a transmission of forces through at least one of the first support or the at least one strut, wherein the reinforcing bar is configured as an at least two-part composite component which is formed as a structural unit comprising an element which transfers tensile forces and an element which transfers compressive forces, wherein the reinforcing bar has a jacket comprising at least one of a steel mesh or a woven steel fabric or a woven textile fabric which is reinforced with at least one of steel, carbon fiber or glass fiber, and wherein the reinforcing bar has a core comprising a cured casting compound;

wherein forming the lattice mast structure further comprises providing the jacket;

connecting the jacket to at least one of the first support or the at least one strut at the at least two points which are remote from one another;

injecting a curable casting compound into the jacket; and curing the curable casting compound to provide the cured casting compound.

15. The method as claimed in claim 14, wherein the reinforcing bar is connected to the first support in a region of node points of the lattice structure.

16. The method as claimed in claim 14, wherein the jacket is a hose.

17. The method as claimed in claim 16, wherein the hose is a textile hose.

* * * * *